US009242827B2

(12) United States Patent
Niimura

(10) Patent No.: US 9,242,827 B2
(45) Date of Patent: Jan. 26, 2016

(54) SHEET STACKING DEVICE AND IMAGE FORMING APPARATUS

(71) Applicant: CANON KABUSHIKI KAISHA, Tokyo (JP)

(72) Inventor: Takeshi Niimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/104,794

(22) Filed: Dec. 12, 2013

(65) Prior Publication Data

US 2014/0167349 A1 Jun. 19, 2014

(30) Foreign Application Priority Data

Dec. 14, 2012 (WO) ..... PCT/JP2012/082495

(51) Int. Cl.

| | |
|---|---|
| ***B65H 31/20*** | (2006.01) |
| ***B65H 31/02*** | (2006.01) |
| ***B65H 31/22*** | (2006.01) |
| ***B65H 31/32*** | (2006.01) |
| ***G03G 15/00*** | (2006.01) |

(52) U.S. Cl.

CPC ..... *B65H 31/22* (2013.01); *B65H 31/02* (2013.01); *B65H 31/20* (2013.01); *B65H 31/32* (2013.01); *G03G 15/6552* (2013.01); *B65H 2301/4212* (2013.01); *B65H 2402/40* (2013.01); *B65H 2402/441* (2013.01); *B65H 2405/1124* (2013.01); *B65H 2405/324* (2013.01); *B65H 2601/324* (2013.01); *B65H 2801/12* (2013.01)

(58) Field of Classification Search

CPC .... B65H 31/20; B65H 31/32; B65H 2402/45; B65H 2402/40; B65H 2405/324; B65H 2405/1124; B41J 13/106

USPC ..... 271/218, 219, 223, 213, 209

See application file for complete search history.

(56) References Cited

U.S. PATENT DOCUMENTS

| | | | | | |
|---|---|---|---|---|---|
| 5,241,353 | A * | 8/1993 | Maeshima et al. | ..... | 399/405 |
| 5,613,672 | A * | 3/1997 | Tanaka et al. | ..... | 271/162 |
| 5,897,113 | A * | 4/1999 | Kondo et al. | ..... | 271/213 |
| 5,975,520 | A * | 11/1999 | Shim | ..... | 271/171 |
| 6,428,000 | B1 * | 8/2002 | Hara et al. | ..... | 271/223 |
| 7,410,164 | B2 * | 8/2008 | Koide et al. | ..... | 271/213 |
| 7,748,706 | B2 * | 7/2010 | Ishii | ..... | 271/218 |
| 7,850,168 | B2 * | 12/2010 | Shinkawa et al. | ..... | 271/223 |
| 8,016,287 | B2 * | 9/2011 | Watanabe | ..... | 271/209 |
| 8,118,301 | B2 * | 2/2012 | Fujii et al. | ..... | 271/207 |
| 8,348,263 | B2 * | 1/2013 | Otani et al. | ..... | 271/213 |
| 8,424,871 | B2 * | 4/2013 | Ino | ..... | 271/220 |

(Continued)

FOREIGN PATENT DOCUMENTS

| | | | |
|---|---|---|---|
| JP | 04223964 | A | 8/1992 |
| JP | 2000016667 | A | 1/2000 |

(Continued)

*Primary Examiner* — Patrick Cicchino

(74) *Attorney, Agent, or Firm* — Canon U.S.A., Inc. IP Division

(57) ABSTRACT

A sheet stacking device including a stacking tray, an auxiliary tray, and pivot limiting means. The stacking tray is disposed to be pivotable relative to an apparatus main body. The stacking tray has a stacking surface on which sheets discharged from discharging means are stacked. The auxiliary tray is pivotable between a storage position at which the auxiliary tray is stored in the stacking tray and a pivot position to which the auxiliary tray pivots from the stacking tray. Pivot limiting means limits pivoting of the auxiliary tray from the pivot position when the stacking tray is caused to pivot.

19 Claims, 13 Drawing Sheets

(56) References Cited

U.S. PATENT DOCUMENTS

| | | | | |
|---|---|---|---|---|
| 8,430,399 | B1 * | 4/2013 | Huang et al. | 271/171 |
| 8,602,412 | B2 * | 12/2013 | Ma | 271/207 |
| 8,608,159 | B2 * | 12/2013 | Takeuchi et al. | 271/145 |
| 9,004,484 | B2 * | 4/2015 | Murakami | 271/145 |
| 2011/0024966 | A1 * | 2/2011 | Fujii et al. | 271/3.14 |
| 2011/0097126 | A1 * | 4/2011 | Kimura et al. | 399/405 |
| 2013/0106043 | A1 * | 5/2013 | Murakami | 271/9.01 |

FOREIGN PATENT DOCUMENTS

| | | | |
|---|---|---|---|
| JP | 2003201054 | A | 7/2003 |
| JP | 2004051350 | A | 2/2004 |
| JP | 2006232501 | A | 9/2006 |
| JP | 2007186293 | A | 7/2007 |
| JP | 2007217163 | A | 8/2007 |
| JP | 2008297042 | A | 12/2008 |
| JP | 2009046219 | A | 3/2009 |

* cited by examiner

FIG. 1A
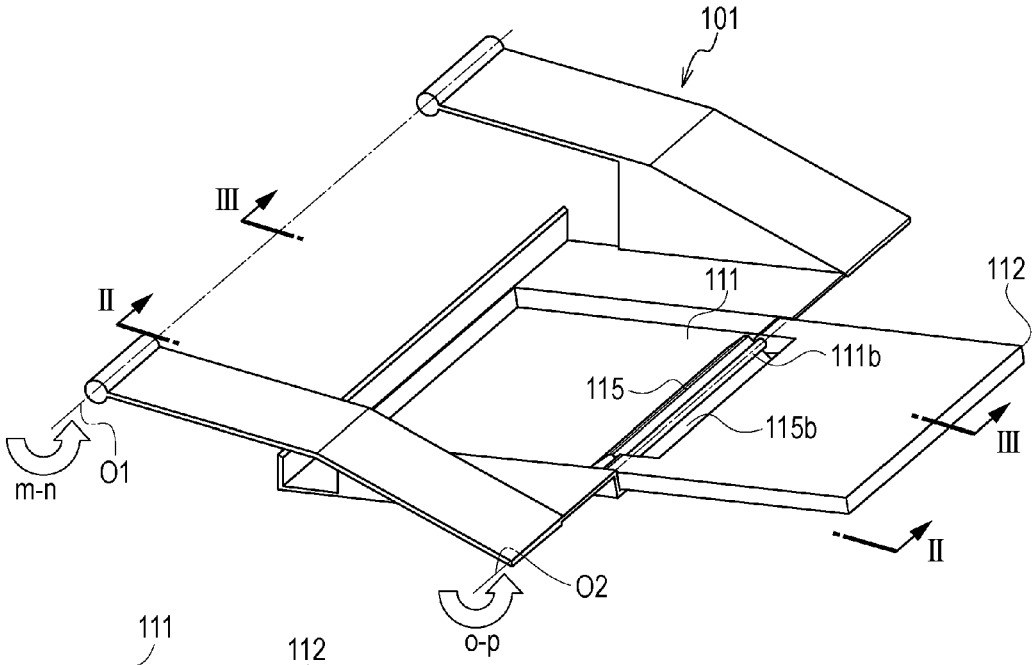
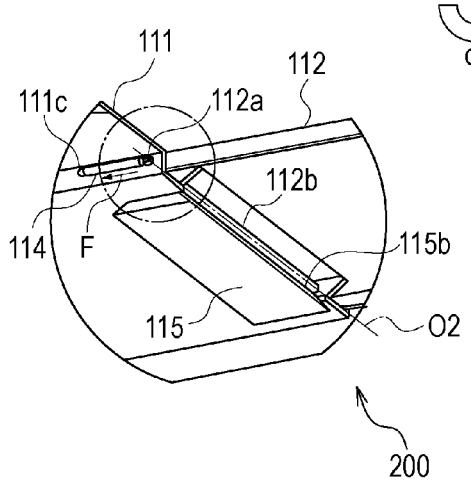
FIG. 1B
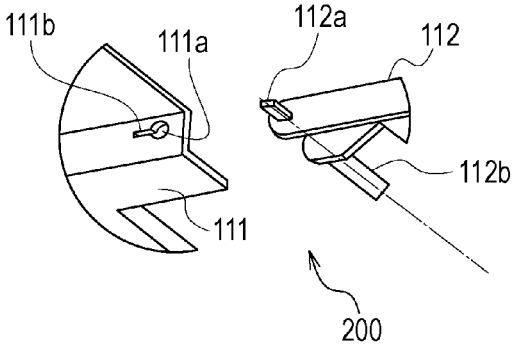
FIG. 1C

FIG. 4A
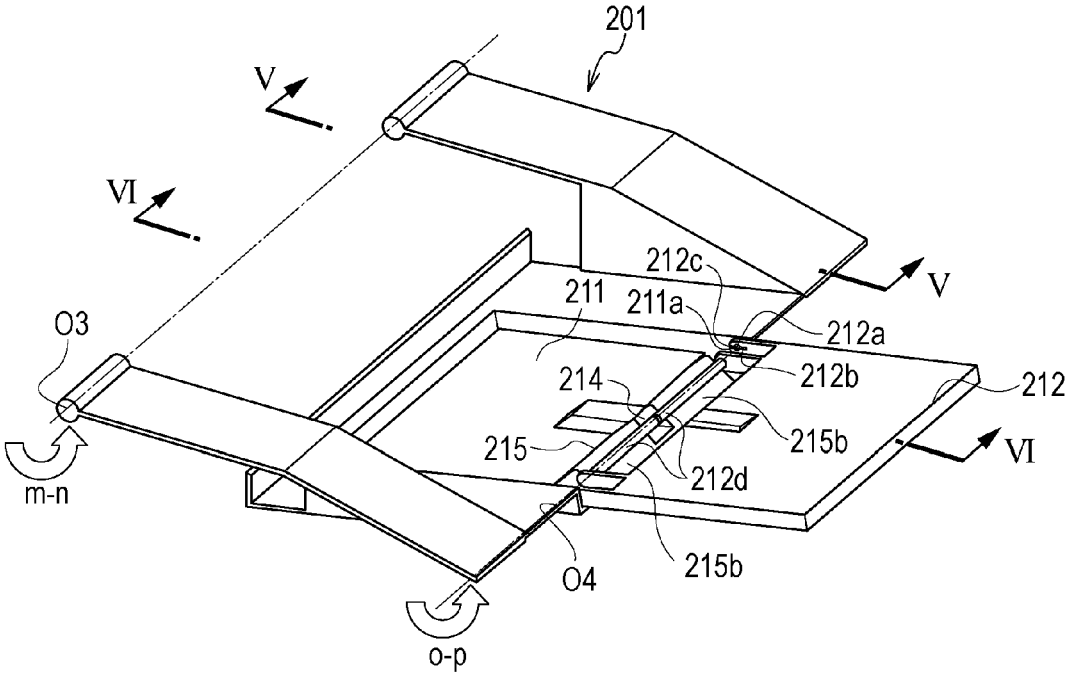
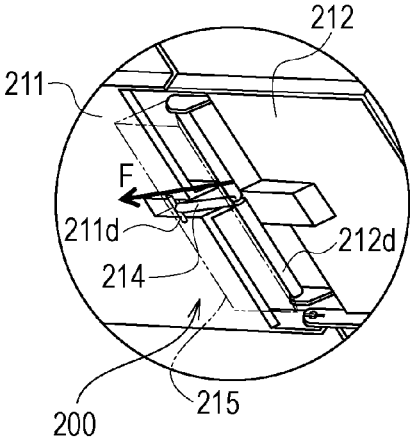
FIG. 4B
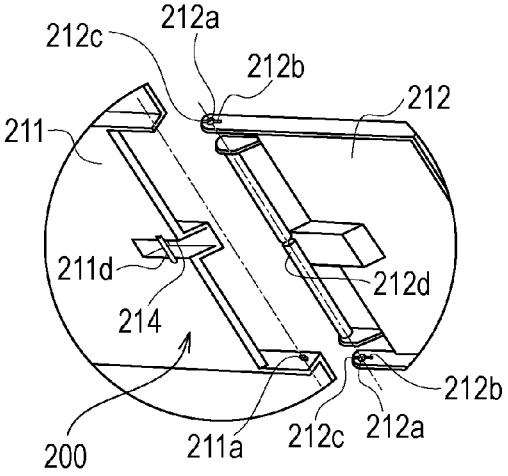
FIG. 4C

FIG. 7A
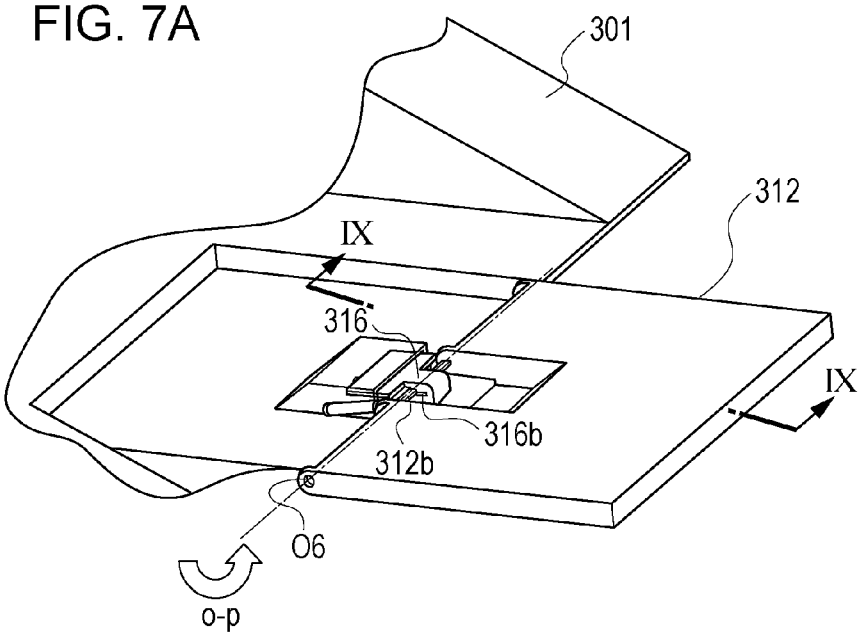
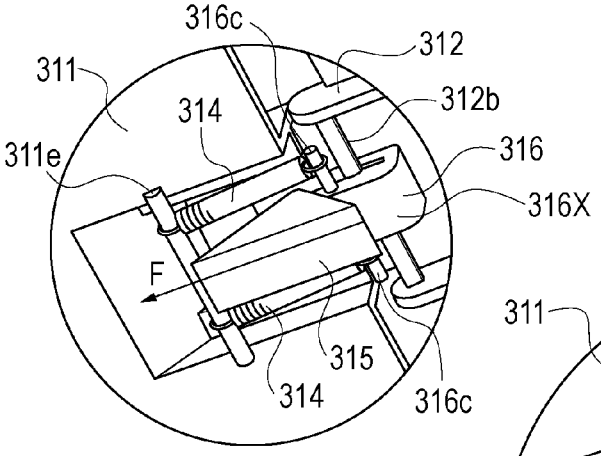
FIG. 7B
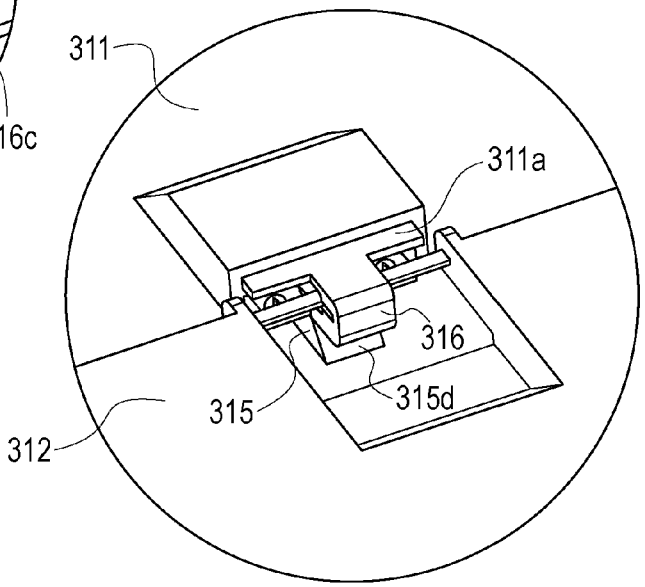
FIG. 7C

SHEET STACKING DEVICE AND IMAGE FORMING APPARATUS

TECHNICAL FIELD

The present invention relates to a sheet stacking device and an image forming apparatus including the sheet stacking device.

BACKGROUND ART

A conventional sheet stacking device for stacking sheets having images formed thereon includes a stacking tray on which sheets are stacked, and an auxiliary tray for extending the stacking surface of the stacking tray.

Patent Literature (PTL) 1 describes a sheet stacking device that includes an auxiliary tray pivotably supported by a stacking tray. As illustrated in FIG. 11, an auxiliary tray 412 described in PTL 1 is disposed to be pivotable about a pivot point O8 between a storage position at which the auxiliary tray 412 is stored in a stacking tray 411 and an extension position at which the auxiliary tray 412 extends the length of a sheet stacking surface of the stacking tray 411 in a sheet discharging direction.

CITATION LIST

Patent Literature

PTL 1 Japanese Patent Laid-Open No. 2008-297042

However, the device described in PTL 1 has room for improvement in the following respect.

In the configuration described in PTL 1, to replace a process cartridge X or to remove a sheet jammed in a conveying path of an apparatus main body 401, the stacking tray 411 needs to be pivotable about a pivot point O7.

FIG. 12 illustrates the stacking tray 411 that has been caused to pivot and open to allow replacement of the process cartridge X. The auxiliary tray 412 is pivotable even in this state. Therefore, as illustrated in FIG. 13, the auxiliary tray 412 may pivot in the direction of arrow U which is a direction not intended by the user. If the auxiliary tray 412 pivots in the direction of arrow U, sheets staked on the stacking tray 411 may fall off.

When the stacking tray 411 is further opened as illustrated in FIG. 14, the auxiliary tray 412 pivots in the direction of arrow V due to its weight, swings in the direction of arrow W, and is not positioned in place. This is not desirable in terms of product quality.

An object of the present invention is to provide a sheet stacking device in which even when a stacking tray is caused to pivot from an apparatus main body, an auxiliary tray pivotable from the stacking tray does not pivot in an unintended direction.

SUMMARY OF INVENTION

The present invention is a sheet stacking device that includes a stacking tray disposed to be pivotable relative to the apparatus main body, the stacking tray having a stacking surface on which sheets discharged from discharging means are stacked, an auxiliary tray pivotable relative to the stacking tray, and pivot limiting means for limiting pivoting of the auxiliary tray when the stacking tray is caused to pivot.

Further features of the present invention will become apparent from the following description of exemplary embodiments with reference to the attached drawings.

BRIEF DESCRIPTION OF DRAWINGS

FIGS. 1A to 1C illustrate a first embodiment of a sheet stacking device to which the present invention is applied.

FIGS. 4A to 4C illustrate a second embodiment of a sheet stacking device to which the present invention is applied.

FIGS. 7A to 7C illustrate a third embodiment of a sheet stacking device to which the present invention is applied.

DESCRIPTION OF EMBODIMENTS

Embodiments of the present invention will now be described with reference to the drawings.

Figure 10:
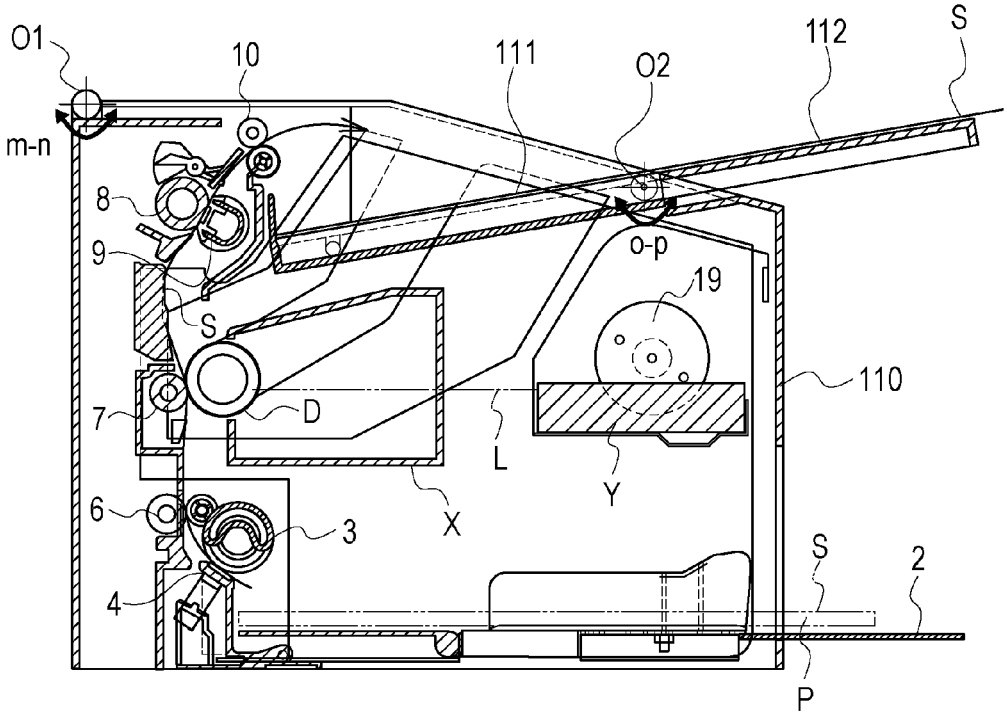
FIG. 10 illustrates an image forming apparatus to which the present invention is applied.
Figure 11:
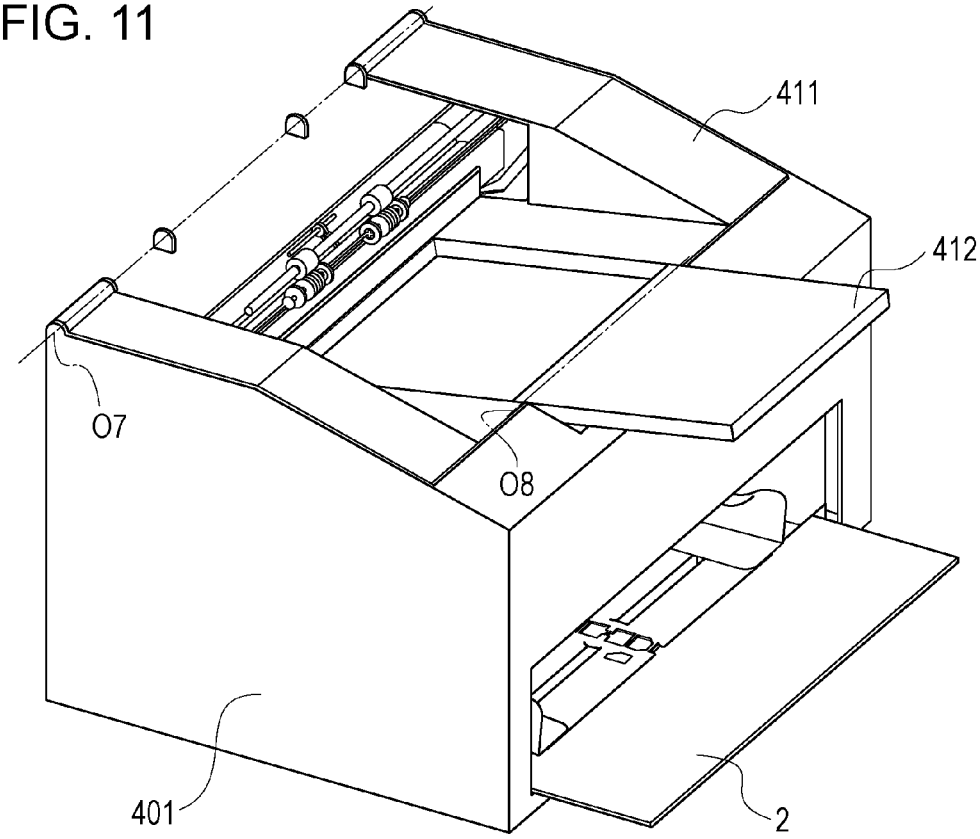
FIG. 11 illustrates a conventional image forming apparatus.
Figure 12:
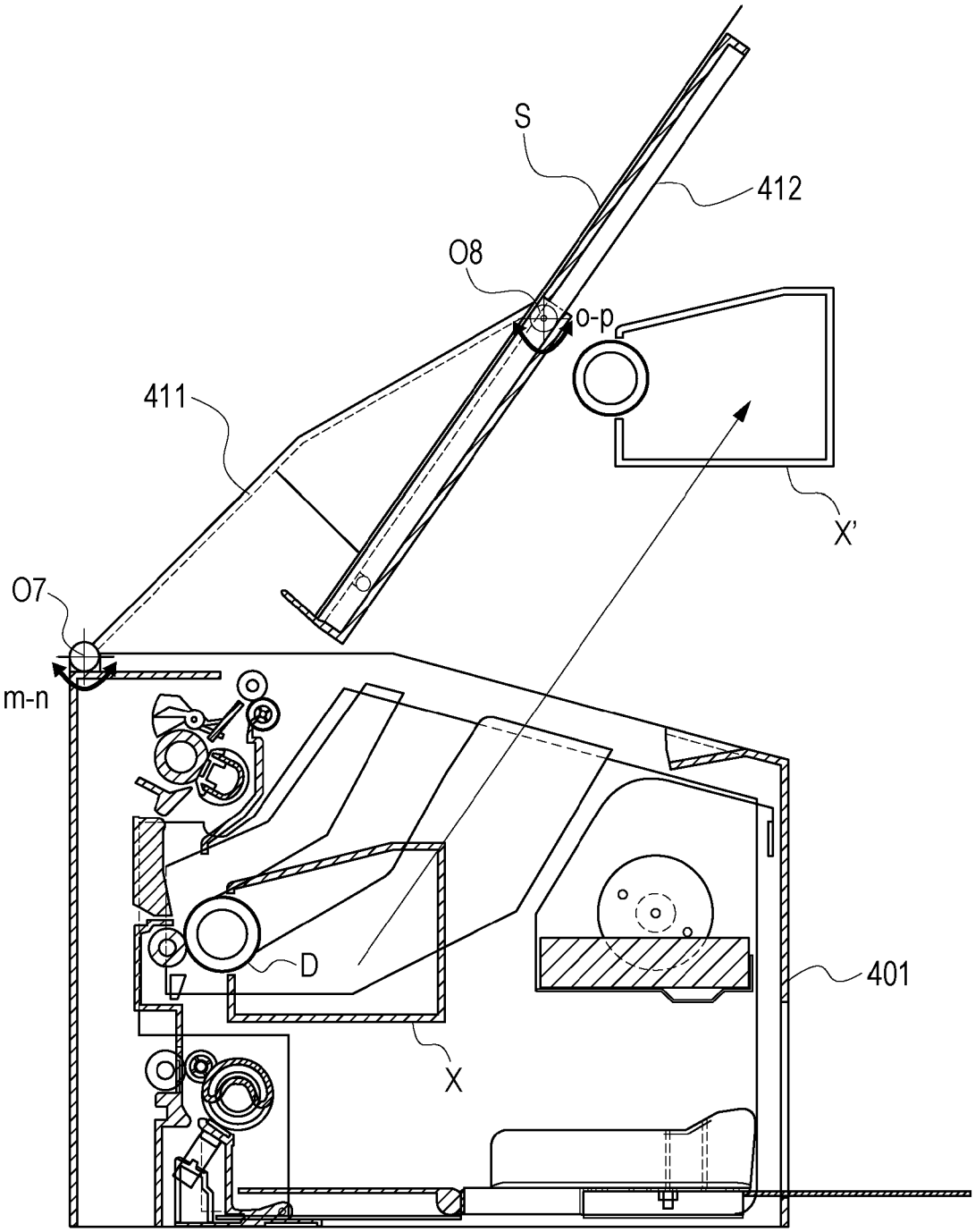
FIG. 12 illustrates the conventional image forming apparatus.
Figure 13:
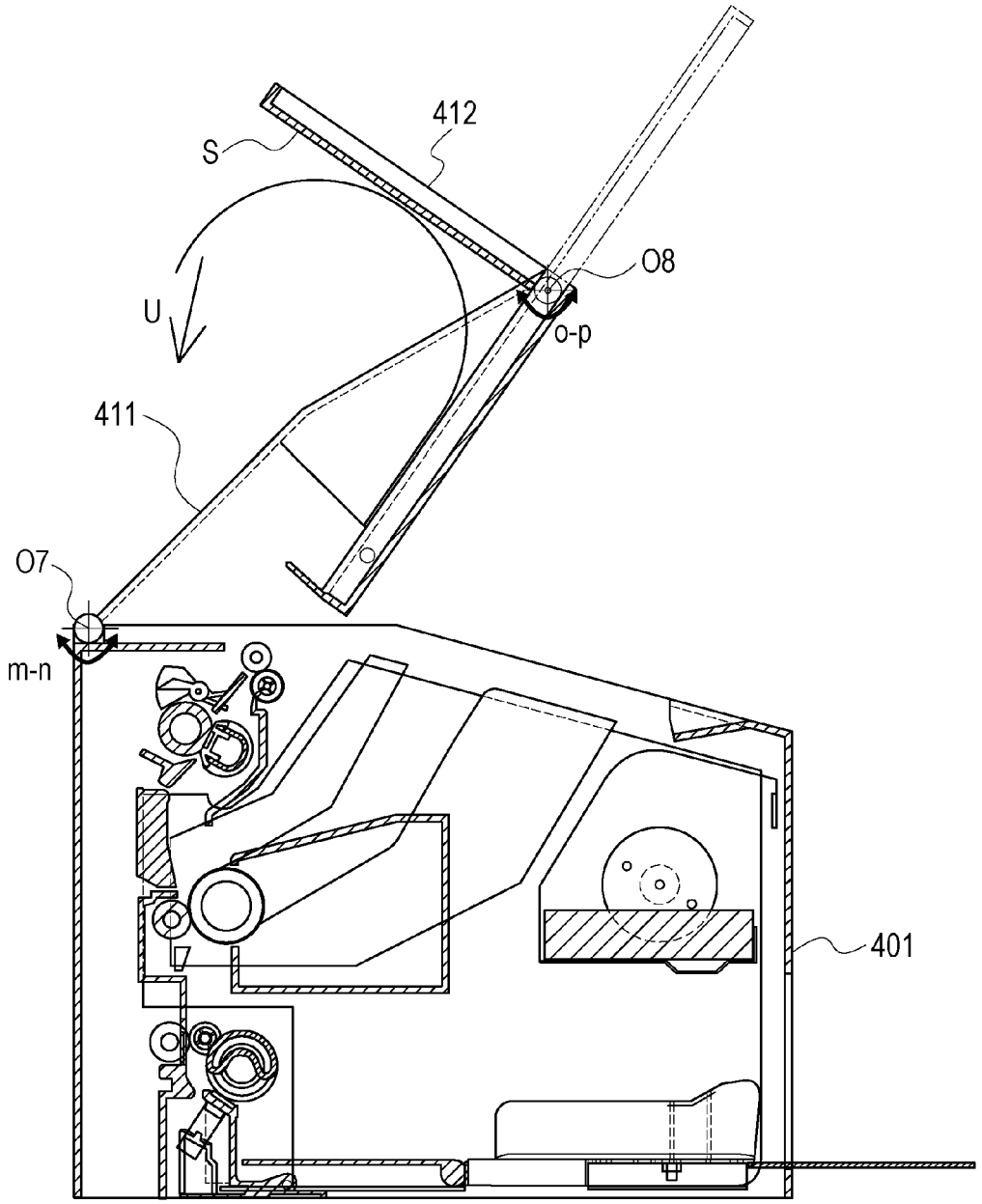
FIG. 13 illustrates the conventional image forming apparatus.
Figure 14:
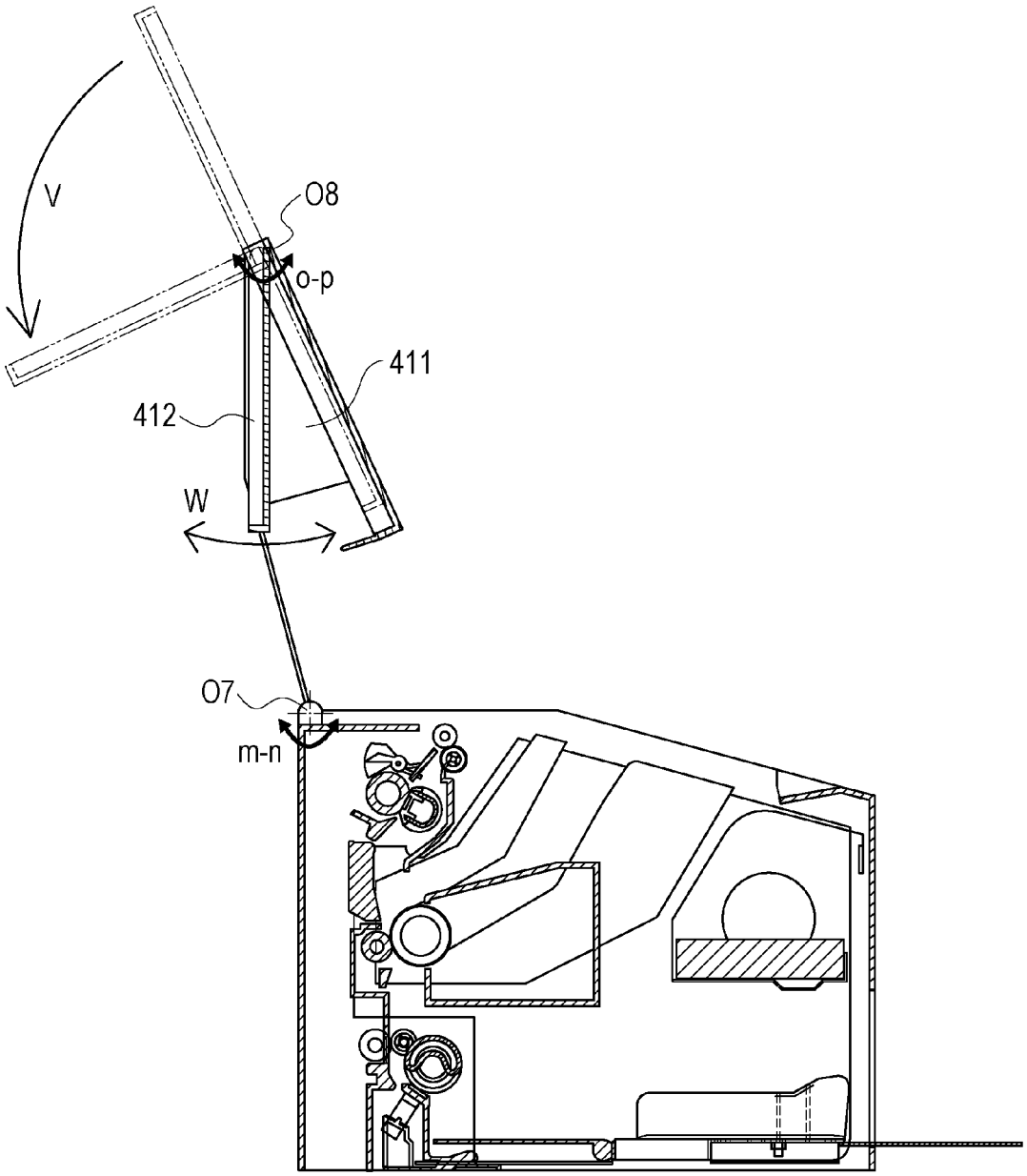
FIG. 14 illustrates the conventional image forming apparatus.

FIG. 10 is a schematic cross-sectional view of an image forming apparatus to which a sheet stacking device of the present invention is applied.

Sheets for forming images are placed as a sheet stack P on a feeding tray 2. Upon receipt of a print start signal from a controller (not shown), a motor 19 starts to drive a feeding roller 3, a conveying roller 6, a photosensitive drum D, a transfer roller 7, a fixing pressure roller 8, and a discharge roller 10.

After receipt of a feeding start signal, the feeding roller 3 is rotated once by a single-rotation control means (not shown). Sheets fed by the feeding roller 3 are separated one by one by a separation pad 4, and an uppermost sheet S is fed toward the conveying roller 6. The sheet S is conveyed by the conveying roller 6 and clears a sheet leading edge detection flag (not shown). A photosensor (not shown) is attached near the sheet leading edge detection flag and detects a leading edge position of the sheet S.

The photosensitive drum D is uniformly charged by a charging roller (not shown). After a predetermined period of time following the detection of the leading edge of the sheet S, a laser beam L emitted from a laser exposure device Y is applied to the photosensitive drum D, so that an electrostatic latent image is formed on the photosensitive drum D. The process cartridge X is filled with toner. As a developing roller (not shown) rotates, an appropriate amount of toner is appropriately charged and supplied onto the photosensitive drum D. The toner on the developing roller adheres to the electrostatic latent image on the photosensitive drum D, so that the latent image is developed and visualized into a toner image. The visualized toner image on the photosensitive drum D is transferred by the transfer roller 7 onto the sheet S. The sheet S having the toner image thereon is conveyed toward a nip formed by a fixing heating member 9 and the fixing pressure roller 8.

The sheet S is subjected to heat and pressure at the nip between the fixing heating member 9 and the fixing pressure roller 8, so that the toner image is fixed onto the sheet S.

The sheet S having an image formed by an image forming unit is discharged to the outside of the apparatus by the discharge roller 10 serving as a discharging means, and is placed on a stacking tray 111.

First Embodiment

A first embodiment of a sheet stacking device according to the present invention will now be described.

FIG. 1A is a perspective view of a sheet stacking device 101 to which the first embodiment is applied. FIGS. 1B and 1C are each an enlarged view of a major part.

Referring to FIG. 1A, the stacking tray 111 having a stacking surface on which sheets are stacked is disposed to be pivotable about a pivot point O1 from an apparatus main body 110. To replace the process cartridge X or to remove a sheet jammed in a conveying path of the apparatus main body 110, the user causes the stacking tray 111 to pivot from a closed position.

An auxiliary tray 112 disposed to be pivotable about a pivot point O2 downstream of the stacking tray 111 in a sheet discharging direction can extend the stacking surface of the stacking tray 111 when the auxiliary tray 112 is caused to pivot outward. The auxiliary tray 112 pivots between a storage position at which the auxiliary tray 112 is stored in the stacking tray 111 and a pivot position to which the auxiliary tray 112 pivots from the stacking tray 111. As illustrated in FIG. 1A, the auxiliary tray 112 extends the stacking surface of the stacking tray 111 at the pivot position and allows large-size sheets to be stacked thereon. The direction in which the stacking tray 111 pivots from the closed state is opposite the direction in which the auxiliary tray 112 pivots from the storage position to the pivot position.

In the sheet stacking device of the present embodiment, when the stacking tray 111 is caused to pivot by more than a predetermined amount, a pivot limiting means 200 limits pivoting of the auxiliary tray 112. The pivot limiting means 200 will now be described.

The pivot limiting means 200 includes a key 112*a* serving as a protrusion of the auxiliary tray 112 and having a so-called I-cut shape with a width t, and a groove located in the stacking tray 111 and having a round hole 111*a* and a key groove shape 111*b*. That is, the key 112*a* is located in the stacking tray 111, which is one of the stacking tray 111 and the auxiliary tray 112, and the key groove 111*b* is located in the auxiliary tray 112, which is the other of the stacking tray 111 and the auxiliary tray 112.

When the key 112*a* is retained in the round hole 111*a*, which is a first position of the groove, the auxiliary tray 112 can pivot because the key 112*a* can rotate in the round hole 111*a*. When the key 112*a* is retained in the key groove 111*b*, which is a second position of the groove, the auxiliary tray 112 cannot pivot because the key 112*a* cannot rotate in the key groove 111*b*.

As illustrated in FIG. 1B, a spring 114 serving as a biasing means is stretched between the key 112*a* and a shaft 111*c* of the stacking tray 111. The spring 114 biases the auxiliary tray 112 in the direction of arrow F, that is, in the direction in which the key 112*a* approaches the key groove 111*b*. The direction of arrow F is opposite the direction in which a sheet is discharged from the image forming apparatus.

The sheet stacking device 101 includes a stopper 115 for holding the auxiliary tray 112 biased by the spring 114. As illustrated in FIGS. 1A and 1B, when the stacking tray 111 is in a closed state, a shaft 112*b* of the auxiliary tray 112 biased by the spring 114 is held by an inclined portion 115*b* of the stopper 115. Thus when the stacking tray 111 is in a closed state, since the key 112*a* is retained in the round hole 111*a*, the auxiliary tray 112 can pivot independently. Note that the shaft 112*b* and the key 112*a* of the auxiliary tray 112 are coaxial with each other.

When the user causes the stacking tray 111 to pivot upward by a predetermined amount, the shaft 112*b* of the auxiliary tray moves upward. Thus, the shaft 112*b* of the auxiliary tray is released from the state of being held by the stopper 115 located in the apparatus main body, and the auxiliary tray 112 is moved in the F direction by the biasing force of the spring 114. As a result, since the key 112*a* is moved in the F direction and retained in the key groove 111*b*, the auxiliary tray 112 becomes unable to pivot. In other words, the auxiliary tray 112 is integrally secured to the stacking tray 111.

With reference to FIGS. 2A to 2D and FIGS. 3A to 3E, actions that take place when the user causes the stacking tray 111 and the auxiliary tray 112 to pivot will be described. FIGS. 2A to 2D are each a cross-sectional view at position II-II. FIGS. 3A to 3E are each a cross-sectional view at position III-III. FIGS. 2A to 2D correspond to FIGS. 3A to 3D.

Figure 2A:
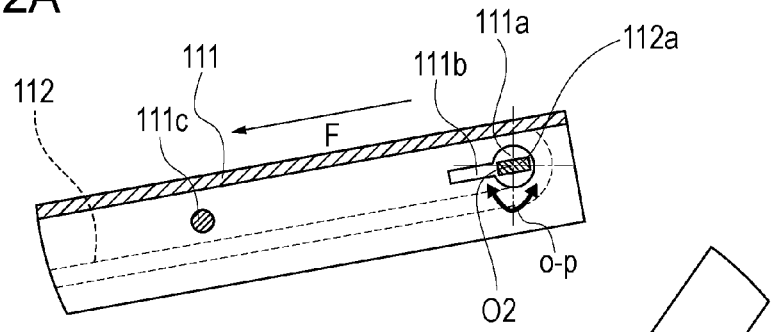
FIGS. 2A to 2D illustrate the first embodiment as viewed from a cross section at position II-II.
Figure 2B:
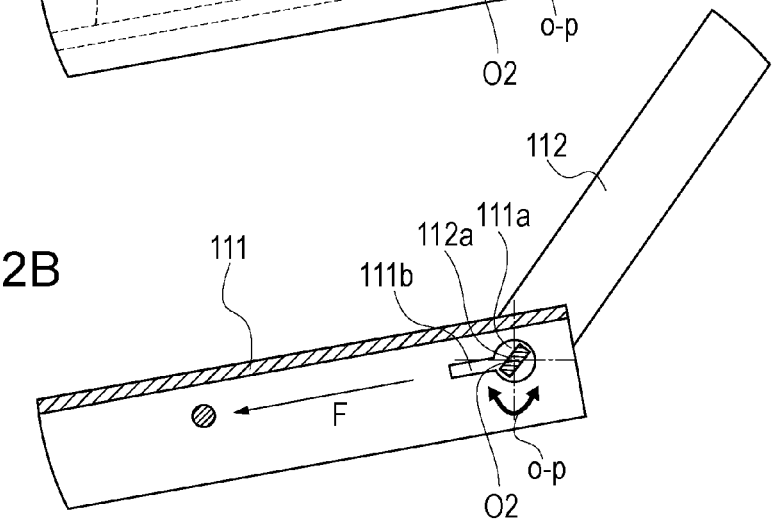
Figure 3A:
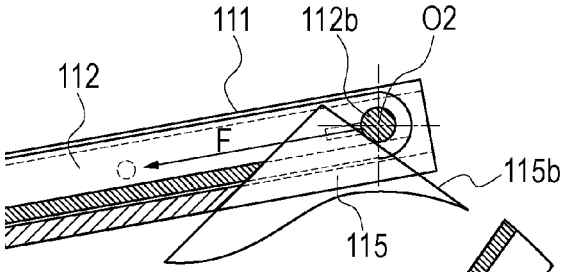
FIGS. 3A to 3E illustrate the first embodiment as viewed from a cross section at position III-III.
Figure 3B:
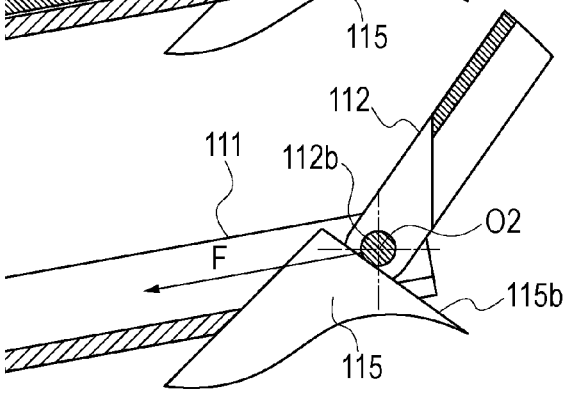

FIGS. 2A and 3A illustrate the stacking tray 111 and the auxiliary tray 112 in a closed state. From this state, the user can cause the auxiliary tray 112 to pivot. As illustrated in FIGS. 2B and 3B, the auxiliary tray 112 pivots about the pivot point O2.

Figure 2C:
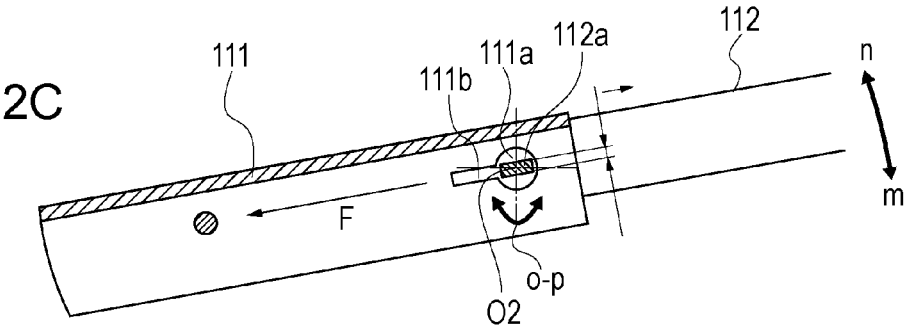
Figure 3C:
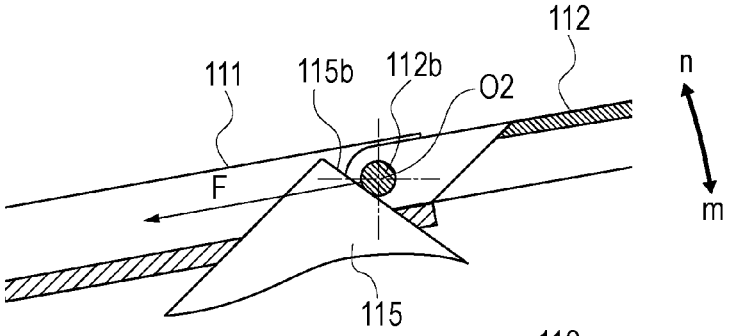

FIGS. 2C and 3C illustrate the auxiliary tray 112 that has been caused to pivot by 180°. In this state, large-size sheets can be stacked on the auxiliary tray 112.

If the amount of pivoting of the stacking tray 111 is less than a predetermined amount, as illustrated in FIGS. 3A to 3C, the shaft 112*b* of the auxiliary tray is biased by the spring 114 in the direction of arrow F and held by the stopper 115.

Figure 2D:
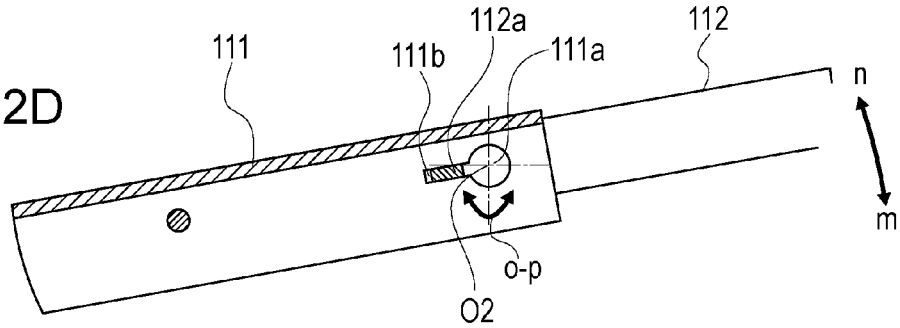

After the auxiliary tray 112 is caused to pivot to the pivot position, if the stacking tray 111 is caused to pivot by a predetermined amount (about one or two degrees in the present embodiment), the shaft 112*b* of the auxiliary tray moves beyond the inclined portion 115*b* of the stopper 115. Thus, the shaft 112*b* of the auxiliary tray is pulled in the direction of arrow F by the biasing force of the spring 114 and its own weight. Then, as illustrated in FIGS. 2D and 3D, the key 112*a* is engaged in the key groove 111*b*.

In this state, the auxiliary tray 112 is locked (secured) to the stacking tray 111 and cannot pivot from the stacking tray 111. Therefore, when the stacking tray 111 is caused to pivot, as illustrated in FIG. 3E, the auxiliary tray 112 moves together with the stacking tray 111 while being secured thereto.

Figure 3D:
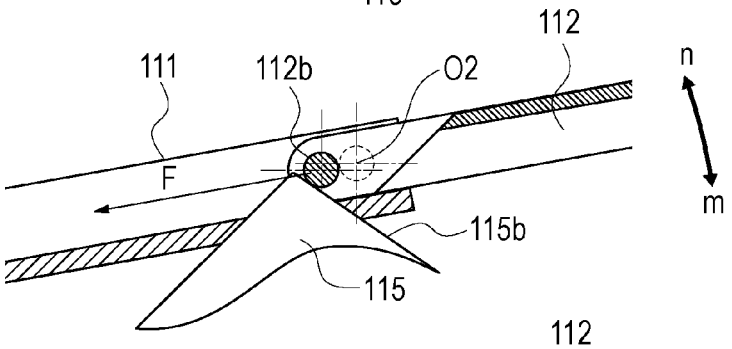
Figure 3E:
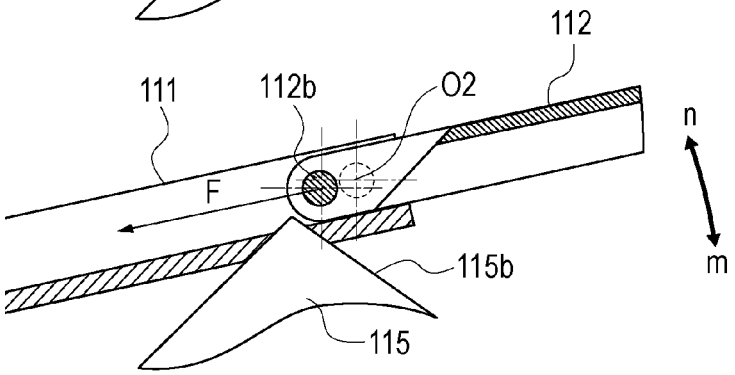

When the stacking tray 111 is closed from the state illustrated in FIG. 3E, the stacking tray 111 comes into the state of FIG. 3D. While the stacking tray 111 is being closed from the state of FIG. 3D and brought into the state of FIG. 3C, the shaft 112*b* of the auxiliary tray 112 comes into contact with the inclined portion 115*b* of the stopper 115. When the stacking tray 111 is further closed, the shaft 112*b* is supported by the inclined portion 115*b* and returned from inside the key groove 111*b* illustrated in FIG. 2D to the position O2 illustrated in FIG. 2C. Thus, the auxiliary tray 112 becomes pivotable in an o-p direction again, and the user can cause the auxiliary tray 112 to pivot and can store it at the storage position.

When the user causes the stacking tray 111 to pivot while the auxiliary tray 112 is stored at the storage position, the pivoting of the auxiliary tray 112 is limited by the pivot limiting means 200 when the stacking tray 111 is caused to pivot by a predetermined amount. Thus, regardless of whether the auxiliary tray 112 is located at the pivot position or the storage position, whenever the stacking tray 111 pivots by a predetermined amount, the auxiliary tray 112 is secured to the stacking tray 111 and moves together therewith.

As described above, in the first embodiment, when the stacking tray 111 is caused to pivot by a predetermined amount, the pivoting of the auxiliary tray 112 is limited by the pivot limiting means 200. Thus, it is possible to prevent the auxiliary tray 112 from pivoting in an unintended direction.

Second Embodiment

A second embodiment of a sheet stacking device according to the present invention will now be described.

The second embodiment differs from the first embodiment in that a stacking tray has a key and an auxiliary tray has a groove. In the following description of the second embodiment, the description of configurations and operations common to those of the first embodiment will be appropriately omitted.

FIG. 4A is a perspective view of a sheet stacking device 201 to which the second embodiment is applied. FIGS. 4B and 4C are each an enlarged view of a major part.

Referring to FIG. 4A, a stacking tray 211 having a stacking surface on which sheets are stacked is disposed to be pivotable about O3 from the apparatus main body. An auxiliary tray 212 is disposed to be pivotable from the stacking tray 211 about a pivot center O4 downstream of the stacking tray 211 in a sheet discharging direction. The auxiliary tray 212 pivots between a storage position at which the auxiliary tray 212 is stored in the stacking tray 211 and a pivot position to which the auxiliary tray 212 pivots from the stacking tray. As illustrated in FIG. 4A, the auxiliary tray 212 extends the stacking surface of the stacking tray 211 at the pivot position and allows large-size sheets to be stacked thereon.

In the sheet stacking device of the present embodiment, when the stacking tray 211 is caused to pivot by a predetermined amount, the pivoting of the auxiliary tray 212 is limited by the pivot limiting means 200. The pivot limiting means 200 will now be described.

The pivot limiting means 200 includes a key 211*a* located in the stacking tray 211, and a round hole 212*a* and a key groove 212*b* located in the auxiliary tray 212.

The auxiliary tray 212 can pivot when the key 211*a* is engaged in the round hole 212*a*, but cannot pivot when the key 211*a* is engaged in the key groove 212*b*.

As illustrated in FIG. 4B, there is a spring 214 between the stacking tray 211 and the auxiliary tray 212. The spring 214 is attached to a spring retainer 211*d* of the stacking tray 211 at one end, and is attached to a shaft 212*d* of the auxiliary tray 212 at the other end. The spring 214 biases the auxiliary tray 212 in the direction of arrow F, that is, in the direction in which the key groove 212*b* is engaged with the key 211*a*.

The sheet stacking device 201 includes a stopper 215 for holding the auxiliary tray 212 biased by the spring 214. As illustrated in FIGS. 4A and 4B, when the stacking tray 211 is in a closed state, the shaft 212*d* of the auxiliary tray 212 biased by the spring 214 is held by an inclined portion 215*b* of the stopper 215. Thus when the stacking tray 211 is in a closed state, since the key 211*a* is retained in the round hole 212*a*, the auxiliary tray 212 can pivot. Note that the round hole 212*a* and the shaft 212*d* of the auxiliary tray 212 are coaxial with each other.

When the user causes the stacking tray 211 to pivot by a predetermined amount, the shaft 212*d* of the auxiliary tray moves upward. Thus, the shaft 212*d* of the auxiliary tray is released from the state of being held by the stopper 215 located in the apparatus main body, and the auxiliary tray 212 is moved in the F direction by the biasing force of the spring 214. As a result, since the round hole 212*a* and the key groove 212*b* are moved in the F direction and the key 211*a* is fitted in the key groove 212*b*, the auxiliary tray 212 becomes unable to pivot.

With reference to FIGS. 5A to 5D and FIGS. 6A to 6E, actions that take place when the user causes the stacking tray 211 and the auxiliary tray 212 to pivot will be described. FIGS. 5A to 5D are each a cross-sectional view at position V-V. FIGS. 6A to 6E are each a cross-sectional view at position VI-VI. FIGS. 5A to 5D correspond to FIGS. 6A to 6D.

Figure 5A:
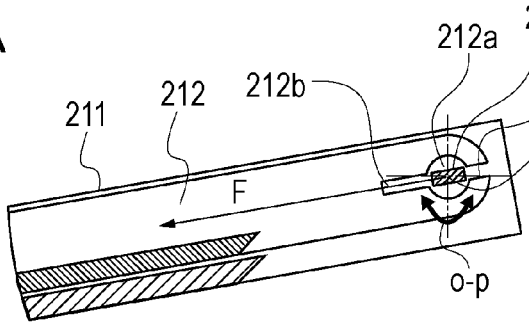
FIGS. 5A to 5D illustrate the second embodiment as viewed from a cross section at position V-V.
Figure 5B:
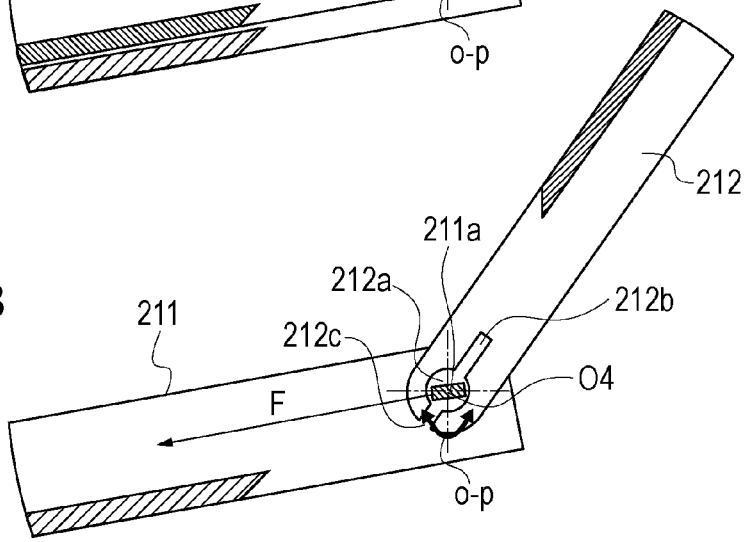
Figure 6A:
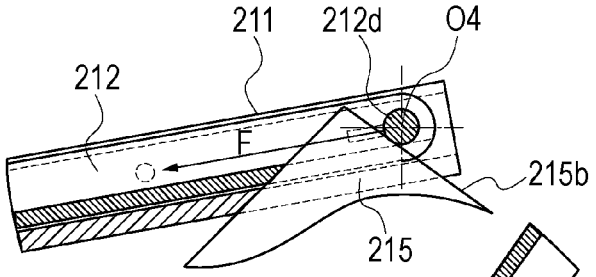
FIGS. 6A to 6E illustrate the second embodiment as viewed from a cross section at position VI-VI.
Figure 6B:
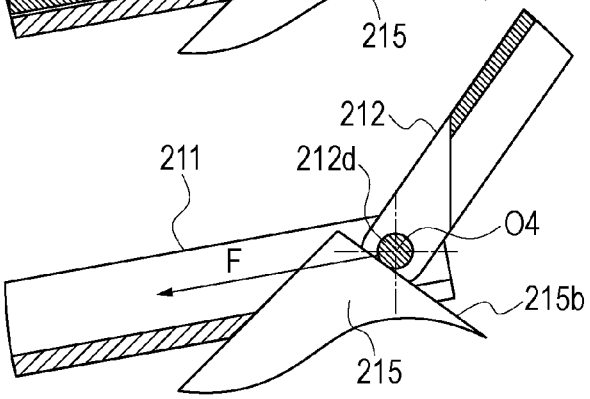

FIGS. 5A and 6A illustrate the stacking tray 211 and the auxiliary tray 212 in a closed state. From this state, the user can cause the auxiliary tray 212 to pivot. As illustrated in FIGS. 5B and 6B, the auxiliary tray 212 pivots about O4.

Figure 5C:
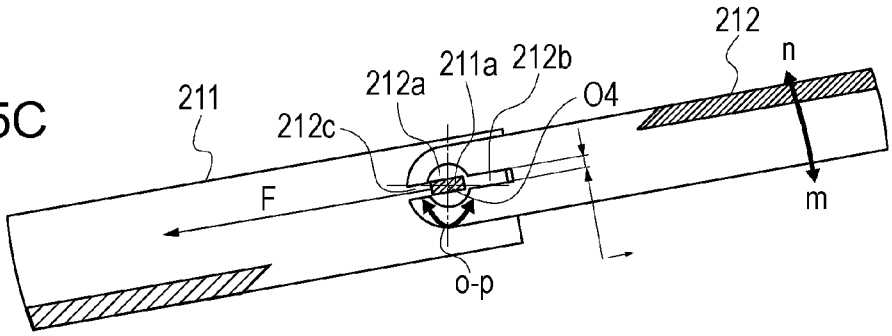
Figure 6C:
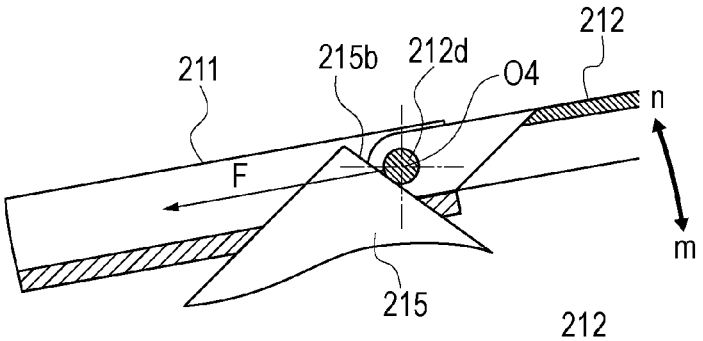

FIGS. 5C and 6C illustrate the auxiliary tray 212 that has been caused to pivot by 180 degrees. In this state, large-size sheets can be stacked on the auxiliary tray 212.

In the states where the stacking tray 211 does not pivot, as illustrated in FIGS. 6A to 6C, the shaft 212*d* of the auxiliary tray is biased by the spring 214 in the direction of arrow F and held by the stopper 215.

Figure 5D:
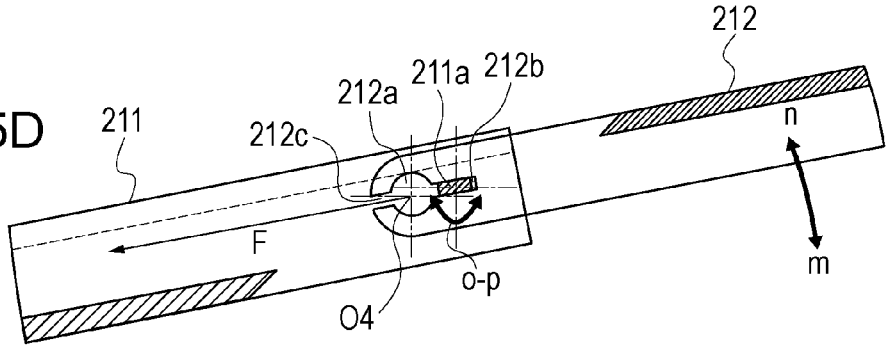
Figure 6D:
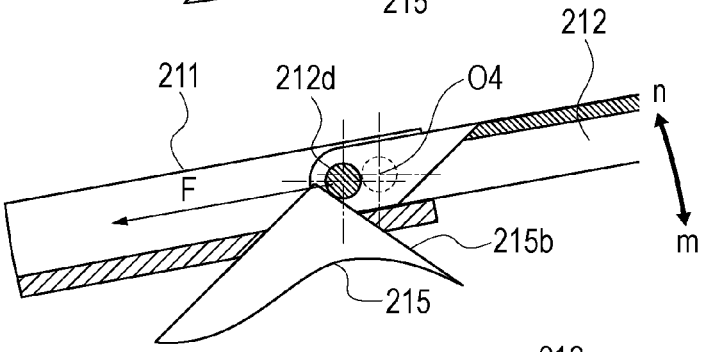

After the auxiliary tray 212 is caused to pivot to the pivot position, if the stacking tray 211 is caused to pivot by a predetermined amount (about one or two degrees in the present embodiment), the shaft 212*d* of the auxiliary tray moves beyond the inclined portion 215*b* of the stopper 215. Thus, the shaft 212*d* of the auxiliary tray is pulled in the direction of arrow F by the biasing force of the spring 214 and its own weight. Then, as illustrated in FIGS. 5D and 6D, the key 211*a* is fitted in the key groove 212*b*.

Figure 6E:
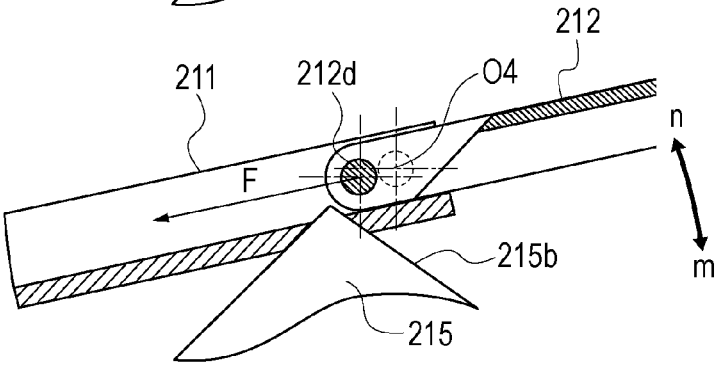

In this state, the auxiliary tray 212 is locked (secured) and cannot pivot from the stacking tray 211. Therefore, when the stacking tray 211 is caused to pivot, as illustrated in FIG. 6E, the auxiliary tray 212 moves together with the stacking tray 211 while being secured thereto.

In the present embodiment, regardless of whether the auxiliary tray 212 is located at the pivot position or the storage position, whenever the stacking tray 211 pivots by a predetermined amount, the auxiliary tray 212 is secured to the stacking tray 211 and moves together therewith.

Third Embodiment

A third embodiment of a sheet stacking device according to the present invention will now be described.

The third embodiment differs from the first embodiment in the configuration of the pivot limiting means. In the following description of the third embodiment, the description of configurations and operations common to those of the first embodiment will be appropriately omitted.

Figure 8:
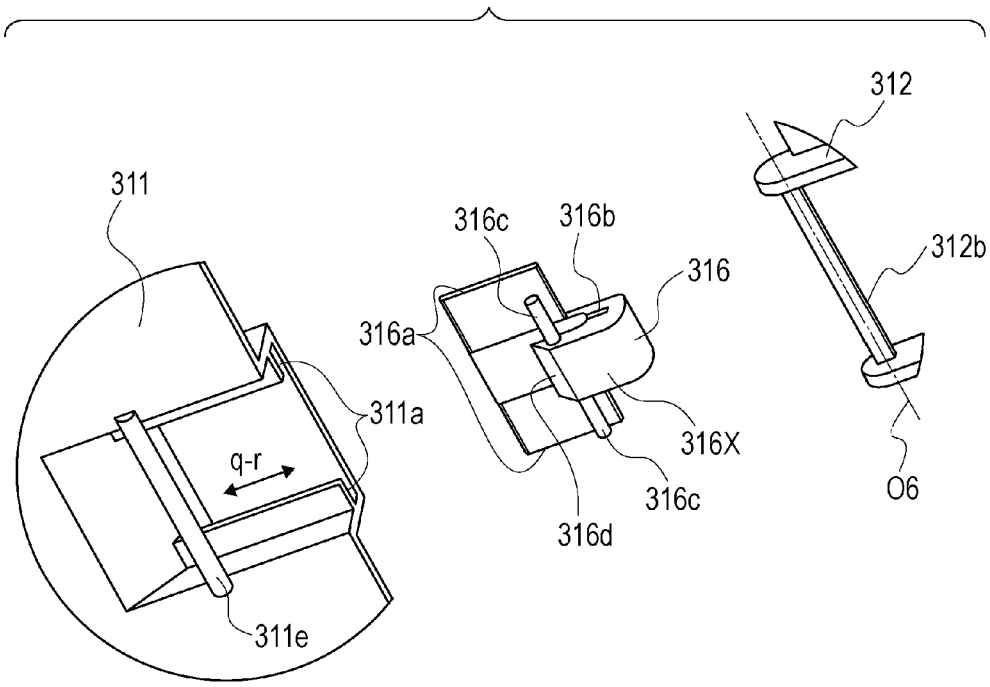
FIG. 8 illustrates the third embodiment of the sheet stacking device to which the present invention is applied.

FIG. 7A is a perspective view of a sheet stacking device 301 to which the third embodiment is applied. FIGS. 7B and 7C are each an enlarged view of a major part. FIG. 8 illustrates a configuration of each portion of the major part. FIGS. 9A to 9E are each a cross-sectional view at position IX-IX.

Referring to FIG. 7A, a stacking tray 311 having a stacking surface on which sheets are stacked is disposed to be pivotable from the apparatus main body. An auxiliary tray 312 is disposed to be pivotable from the stacking tray 311 about a pivot center O6 downstream of the stacking tray 311 in a sheet discharging direction. The auxiliary tray 312 pivots between a storage position at which the auxiliary tray 312 is stored in the stacking tray 311 and a pivot position to which the auxiliary tray 312 pivots from the stacking tray. As illustrated in FIG. 7A, the auxiliary tray 312 extends the stacking surface of the stacking tray 311 at the pivot position and allows large-size sheets to be stacked thereon. The auxiliary tray 312 is pivotably retained at both ends thereof by a support shaft of the stacking tray 311.

The third embodiment includes a phase limiting unit 316 for limiting the phase of the auxiliary tray 312.

As illustrated in FIG. 8, the phase limiting unit 316 has a plate-like slide portion 316*a*, a main body 316X U-shaped shaped in cross section, and a shaft 316*c* at an end of the main body 316X. An inside of the U-shaped main body 316X is provided with a key groove 316*b*.

An end of the stacking tray 311 adjacent to the auxiliary tray 312 is provided with a groove 311*a* into which the slide portion 316*a* of the phase limiting unit 316 is inserted. The stacking tray 311 has a shaft 311*e* near the groove 311*a*.

The auxiliary tray 312 has a shaft 312*b* coaxial with the pivot center O6. The shaft 312*b* has a key shape and is fitted in the key groove 316*b* of the phase limiting unit 316.

As illustrated in FIGS. 7B and 7C, with the shaft 312*b* of the auxiliary tray 312 disposed inside the U-shaped main body 316X of the phase limiting unit 316, the slide portion 316*a* is inserted into the groove 311*a* of the stacking tray 311. The slide portion 316*a* is guided by the groove 311*a*. Thus, the phase limiting unit 316 is retained by the stacking tray 311 to be swingable in a q-r direction in FIG. 8.

As illustrated in FIG. 7B, there are springs 314 between the shaft 316*c* of the phase limiting unit 316 and the shaft 311*e* of the stacking tray 311. The phase limiting unit 316 is biased in the direction of arrow F in FIG. 7B by the force of the springs 314. An inclined portion 316*d* of the phase limiting unit 316 is held at an inclined portion 315*d* of a support member 315 secured to the apparatus main body.

The shaft 312*b* coaxial with the pivot center O6 of the auxiliary tray 312 has a key shape and is fitted in the key groove 316*b* of the phase limiting unit 316. The auxiliary tray 312 cannot pivot when the shaft 312*b* having a key shape is fitted in the key groove 316*b*.

Figure 9A:
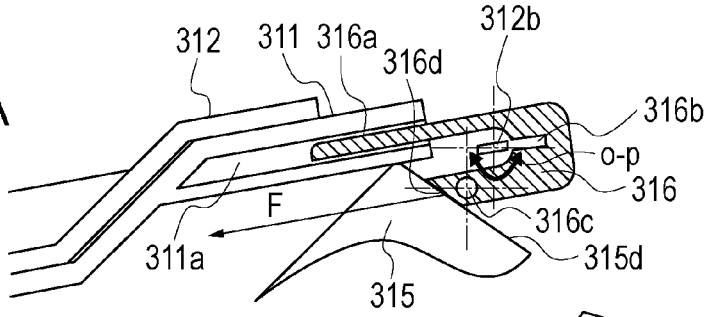
FIGS. 9A to 9E illustrate illustrates the third embodiment as viewed from a cross section at position IX-IX.
Figure 9B:
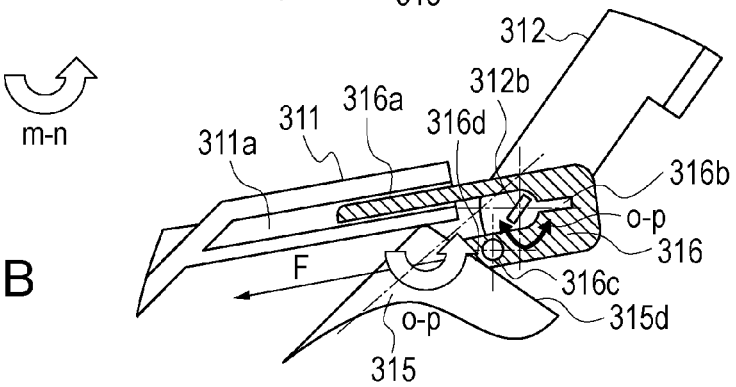

As illustrated in FIGS. 9A and 9B, when the stacking tray 311 is in a closed state, the inclined portion 316*d* of the phase limiting unit 316 is held at the inclined portion 315*d* of the support member 315 secured to the apparatus main body. The auxiliary tray 312 can pivot because the shaft 312*b* having a key shape is not fitted in the key groove 316*b* at this point.

Figure 9C:
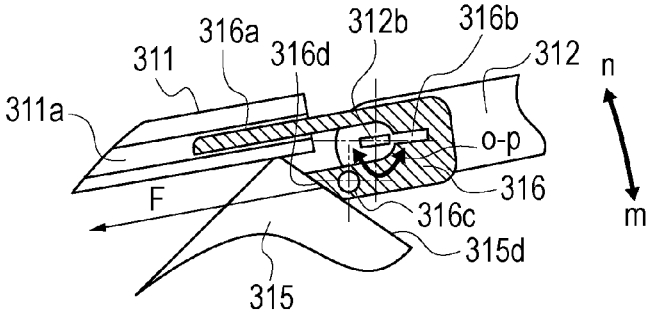
Figure 9D:
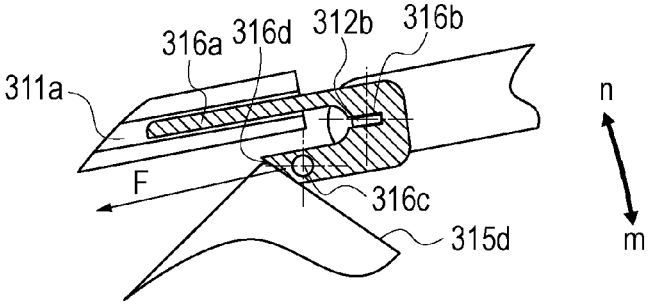

FIG. 9C illustrates the auxiliary tray 312 that has been caused to pivot. When the user causes the stacking tray 311 to pivot from this state, the groove 311*a* of the stacking tray 311 is inclined. By the biasing force of the springs 314 and the weight of the phase limiting unit 316, the slide portion 316*a* of the phase limiting unit 316 is guided by the groove 311*a* and moved in the direction of arrow F. Then as illustrated in FIG. 9D, since the key-shaped shaft 312*b* is fitted in the key groove 316*b*, the auxiliary tray 312 becomes unable to pivot.

Figure 9E:
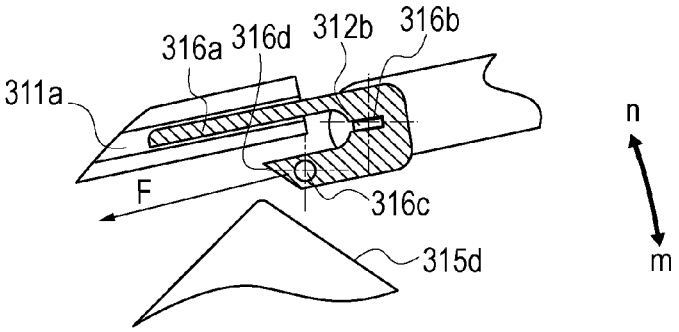

Thus as illustrated in FIG. 9E, even when the user causes the stacking tray 311 to pivot further, it is possible to prevent the auxiliary tray 312 from pivoting in an unintended direction.

In the example described above, the shaft 312*b* of the auxiliary tray 312 has a key shape, and the phase limiting unit 316 slidably retained by the stacking tray 311 is provided with the key groove 316*b*. Alternatively, the auxiliary tray 312 may be provided with a key groove and the phase limiting unit 316 may be provided with a protrusion that can be fitted in the key groove.

In the example described above, the phase limiting unit 316 is disposed to be slidable relative to the stacking tray 311 and brought into engagement with the auxiliary tray 312, thereby limiting the pivoting of the auxiliary tray 312. Alternatively, the phase limiting unit 316 may be disposed to be slidable relative to the auxiliary tray 312 and brought into engagement with the stacking tray 311, thereby limiting the pivoting of the auxiliary tray 312.

According to the present invention, when the stacking tray is caused to pivot, the pivot limiting means limits the pivoting of the auxiliary tray. Therefore, it is possible to prevent the auxiliary tray from pivoting in an unintended direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2012/082495, filed Dec. 14, 2012, which is hereby incorporated by reference herein in its entirety.

The invention claimed is:

1. A sheet stacking device comprising:

a discharging unit configured to discharge a sheet;

a stacking portion disposed to be pivotable relative to an apparatus main body between a first close position and a first pivot position, the stacking portion positioned at the first close position having a stacking surface on which the sheet discharged from the discharging unit being stacked;

an auxiliary portion disposed to be pivotable relative to the stacking portion positioned at the first close position between a second close position and a second pivot position, the auxiliary portion positioned at the second pivot position extends the stacking surface of the stacking portion, wherein a first pivoting direction of the stacking portion from the first close position to the first pivot position is opposite to a second pivoting direction of the auxiliary portion from the second close portion to the second pivot position, and wherein the stacking portion and the auxiliary portion are pivotable integrally in a case the stacking portion is caused to pivot in the first direction from the first close position; and a pivot restricting unit configured to restrict pivoting of the auxiliary portion relative to the stacking portion in the first pivoting direction in a case the stacking portion is caused to pivot in the first pivoting direction from the first close position, wherein the stacking portion includes an opening portion from which the sheet being discharged by the discharging unit to the stacking surface.

2. The sheet stacking device according to claim 1, wherein the pivot restricting unit includes a protrusion and a groove engaged with the protrusion;

the groove has a first groove portion; and in a case the protrusion and the first groove portion are engaged with each other, the pivoting of the auxiliary portion relative to the stacking portion is restricted.

3. The sheet stacking device according to claim 2, wherein the groove has a second groove portion; and in a case the protrusion and the second groove portion are engaged with each other, the auxiliary portion is pivotable.

4. The sheet stacking device according to claim 2, wherein the protrusion is located in one of the stacking portion and the auxiliary portion, and the groove is located in the other of the stacking portion and the auxiliary portion.

5. The sheet stacking device according to claim 3, further comprising a biasing unit for biasing the protrusion or the groove, wherein in a case the stacking portion is caused to pivot by more than a predetermined amount, the protrusion and the first groove portion are brought into engagement by a biasing force applied by the biasing unit to the protrusion or the groove.

6. The sheet stacking device according to claim 5, further comprising a stopper located in the apparatus main body, the stopper being configured to hold the protrusion or the groove under a biasing force of the biasing unit such that in a case the amount of pivoting of the stacking portion is less than a predetermined amount, the protrusion is engaged in the second groove portion.

7. The sheet stacking device according to claim 6, wherein the stopper has an inclined portion, and in a case the stacking portion is closed, the protrusion retained at the first groove portion is supported by the inclined portion and moved to the second groove portion against the biasing force.

8. The sheet stacking device according to claim 3, wherein the protrusion has a key shape, the first groove portion has a key groove shape, and the second groove portion has a round hole.

9. An image forming apparatus comprising:

an image forming unit configured to form an image on a sheet; and the sheet stacking device according to claim 1, the sheet stacking device being a device on which sheets having images formed thereon by the image forming unit are stacked.

10. The sheet stacking device according to claim 1, wherein in a case the stacking portion is caused to pivot in the first pivoting direction by more than a predetermined amount, the pivot restricting unit restrict pivoting of the auxiliary portion relative to the stacking portion in the first pivoting direction.

11. The sheet stacking device according to claim 1, wherein the pivot restricting unit restrict pivoting of the auxiliary portion positioned at the second pivot position relative to the stacking portion in the first pivoting direction in a case the stacking portion is caused to pivot in the first pivoting direction from the first close position.

12. A sheet stacking device comprising:

a discharging unit configured to discharge a sheet;

a stacking portion disposed to be pivotable relative to an apparatus main body between a first close position and a first pivot position, the stacking portion positioned at the first close position having a stacking surface on which the sheet discharged from the discharging unit being stacked;

an auxiliary portion disposed to be pivotable relative to the stacking portion positioned at the first close position between a second close position and a second pivot position, the auxiliary portion positioned at the second pivot position extends the stacking surface of the stacking portion; and a pivot restricting unit configured to restrict pivoting of the auxiliary portion relative to the stacking portion in a case the stacking portion is caused to pivot from the first close position, wherein the stacking portion includes an opening portion from which the sheet being discharged by the discharging unit to the stacking surface.

13. The sheet stacking device according to claim 12, wherein the pivot restricting unit includes a protrusion and a groove engaged with the protrusion;

the groove has a first groove portion; and in a case the protrusion and the first groove portion are engaged with each other, the pivoting of the auxiliary portion relative to the stacking portion is restricted.

14. The sheet stacking device according to claim 13, wherein the groove has a second groove portion; and in a case the protrusion and the second groove portion are engaged with each other, the auxiliary portion is pivotable.

15. The sheet stacking device according to claim 13, wherein the protrusion is located in one of the stacking portion and the auxiliary portion, and the groove is located in the other of the stacking portion and the auxiliary portion.

16. The sheet stacking device according to claim 14, further comprising biasing unit for biasing the protrusion or the groove, wherein in a case the stacking portion is caused to pivot by more than a predetermined amount, the protrusion and the first groove portion are brought into engagement by a biasing force applied by the biasing unit to the protrusion or the groove.

17. The sheet stacking device according to claim 16, further comprising a stopper located in the apparatus main body, the stopper being configured to hold the protrusion or the groove under a biasing force of the biasing unit such that in a case the amount of pivoting of the stacking portion is less than a predetermined amount, the protrusion is engaged in the second groove portion.

18. The sheet stacking device according to claim 17, wherein the stopper has an inclined portion, and in a case the stacking portion is closed, the protrusion retained at the first groove portion is supported by the inclined portion and moved to the second groove portion against the biasing force.

19. The sheet stacking device according to claim 14, wherein the protrusion has a key shape, the first groove portion has a key groove shape, and the second groove portion has a round hole.

* * * * *